US008616858B2

(12) United States Patent
Rosner

(10) Patent No.: US 8,616,858 B2
(45) Date of Patent: Dec. 31, 2013

(54) DUAL POSITIVE DISPLACEMENT PUMP PRESSURE REGULATING CONTROL

(75) Inventor: Jason E. Rosner, Southington, CT (US)

(73) Assignee: United Technologies Corporation, Hartford, CT (US)

( * ) Notice: Subject to any disclaimer, the term of this patent is extended or adjusted under 35 U.S.C. 154(b) by 44 days.

(21) Appl. No.: 13/229,029

(22) Filed: Sep. 9, 2011

(65) Prior Publication Data

US 2013/0061932 A1 Mar. 14, 2013

(51) Int. Cl.
*F04B 49/24* (2006.01)
*F04B 23/04* (2006.01)

(52) U.S. Cl.
USPC ..... 417/304; 417/3; 417/288; 417/428; 137/115.03

(58) Field of Classification Search
USPC ..... 417/3, 288, 299, 304, 426, 427, 428; 60/429, 430; 137/115.26, 115.03
See application file for complete search history.

(56) References Cited

U.S. PATENT DOCUMENTS 2,835,323 A * 5/1958 Booth ..... 137/565.33
2,846,848 A * 8/1958 Coker ..... 60/429
3,385,312 A * 5/1968 Kinnamon et al. ..... 137/118.06
3,917,436 A 11/1975 Dower
3,952,510 A * 4/1976 Peterson ..... 60/403
4,116,577 A * 9/1978 Lauck ..... 417/286
4,164,119 A * 8/1979 Parquet ..... 60/428
4,514,147 A 4/1985 Borman et al.
4,559,965 A * 12/1985 Mickelson ..... 137/115.21
4,585,169 A 4/1986 Kinsey
4,850,813 A 7/1989 Fisher
5,549,361 A * 8/1996 Sorensen ..... 303/3
6,250,894 B1 * 6/2001 Dyer et al. ..... 417/279
6,293,765 B1 * 9/2001 Peterson ..... 417/288
7,506,506 B2 * 3/2009 Krieger ..... 60/430
7,841,841 B2 * 11/2010 Arnett et al. ..... 417/304
2012/0156061 A1 * 6/2012 Baker et al. ..... 417/288

* cited by examiner

*Primary Examiner* — Devon Kramer
*Assistant Examiner* — Nathan Zollinger
(74) *Attorney, Agent, or Firm* — Carlson, Gaskey & Olds, P.C.

(57) ABSTRACT

A hydraulic system, including fluid flow generated by a primary pump and a secondary pump, utilizes a regulator control assembly to control fluid flow from each of the primary and secondary pumps such that a desired fluid flow and pressure is maintained at the outlet for varying actuator demands. The regulator control assembly controls the transition from using only the primary pump, to using both the primary and secondary pumps to provide a desired fluid flow and pressure through the outlet to the actuator.

13 Claims, 5 Drawing Sheets

DUAL POSITIVE DISPLACEMENT PUMP PRESSURE REGULATING CONTROL

STATEMENT REGARDING FEDERALLY SPONSORED RESEARCH OR DEVELOPMENT

This subject of this disclosure was made with government support under Contract No.: N00019-02-C-3003 awarded by the United States Navy. The government therefore may have certain rights in the disclosed subject matter.

BACKGROUND

This disclosure generally relates to a hydraulic control unit for regulating fluid flow. More particularly, this disclosure relates to a hydraulic control unit for controlling an output pressure provided by at least two pumps.

Positive displacement pumps are utilized to satisfy the high pressure flow demands of a variety of flow applications, including fuel, lubrication and hydraulic actuation systems. Such systems require a large pump capable of providing sufficient fluid flow for the highest demand levels. Moreover, many such systems require variable pressure setting capabilities. However, most operating conditions do not require the highest level of fluid flow. Therefore much of the fluid is simply bypassed to the pump supply or reservoir. Operating a pump at such high bypass levels is inefficient and generates waste heat. The thermal problem is further exacerbated when a high pressure is set. An alternate solution is to utilize a relatively small primary pump, capable of providing pressure and flow associated with low and normal operational demands, in concert with a secondary pump engaged when higher flows are required. Such a multi-pump system introduces additional control challenges. Pressure rise through the secondary pump(s) must be minimized, while still providing a smooth and quick transient response to suddenly increased pressure and flow demand.

SUMMARY

A disclosed example hydraulic system utilizes fluid flow provided by a primary pump and a secondary pump. A regulator control assembly controls fluid flow from each of the primary and secondary pumps such that a desired pressure is maintained at the outlet for varying system flow demands. The primary pump provides sufficient fluid flow for most operational conditions. The secondary pump provides additional fluid flow when system demands increase beyond the capability of the primary pump.

The regulator control assembly controls the transition from using only the primary pump, to using both the primary and secondary pumps such that desired fluid flow and pressure through the outlet to the actuator is provided. The regulating control assembly includes a primary regulating valve controlling fluid flow through a primary passage and a secondary regulating valve controlling fluid flow through the secondary passage. A portion of the primary regulating valve provides fluid flow that actuates the secondary regulating valve, responsive to a demand for fluid flow beyond what can be provided by the primary pump. Actuation of the secondary regulating valve in turn moves a mixing valve to unblock the secondary passage to allow fluid flow from the secondary pump to the outlet while latching the primary regulating valve in a desired position. The secondary regulating valve controls fluid flow and pressure to the outlet when the primary regulating valve is latched.

The regulator control assembly incorporates a closed-loop electronic controller to set the output pressure. The regulator control assembly also includes a pressure sensor, just upstream of the outlet port, providing feedback to the electronic controller. For each regulating valve, there is a flow passage from the control unit discharge line, just upstream of the outlet port, to the pump supply. An electro-hydraulic servo valve(s) modulates the entrant ports for both of these flow passages in response to a signal from the electronic controller. For the primary regulating valve, this flow circuit passes through the cavity formed by the valve sleeve and the pressure reference-side valve face. Flow continues on through a port in the mixing valve to a back-pressure orifice and on to the pump supply. For the secondary regulating valve, the passage flows through a port in the primary regulating valve to the cavity formed by the secondary valve sleeve and the pressure reference-side valve face. Flow continues on through a second back-pressure orifice to the pump supply.

These and other features disclosed herein can be best understood from the following specification and drawings, the following of which is a brief description.

DETAILED DESCRIPTION

Figure 1:
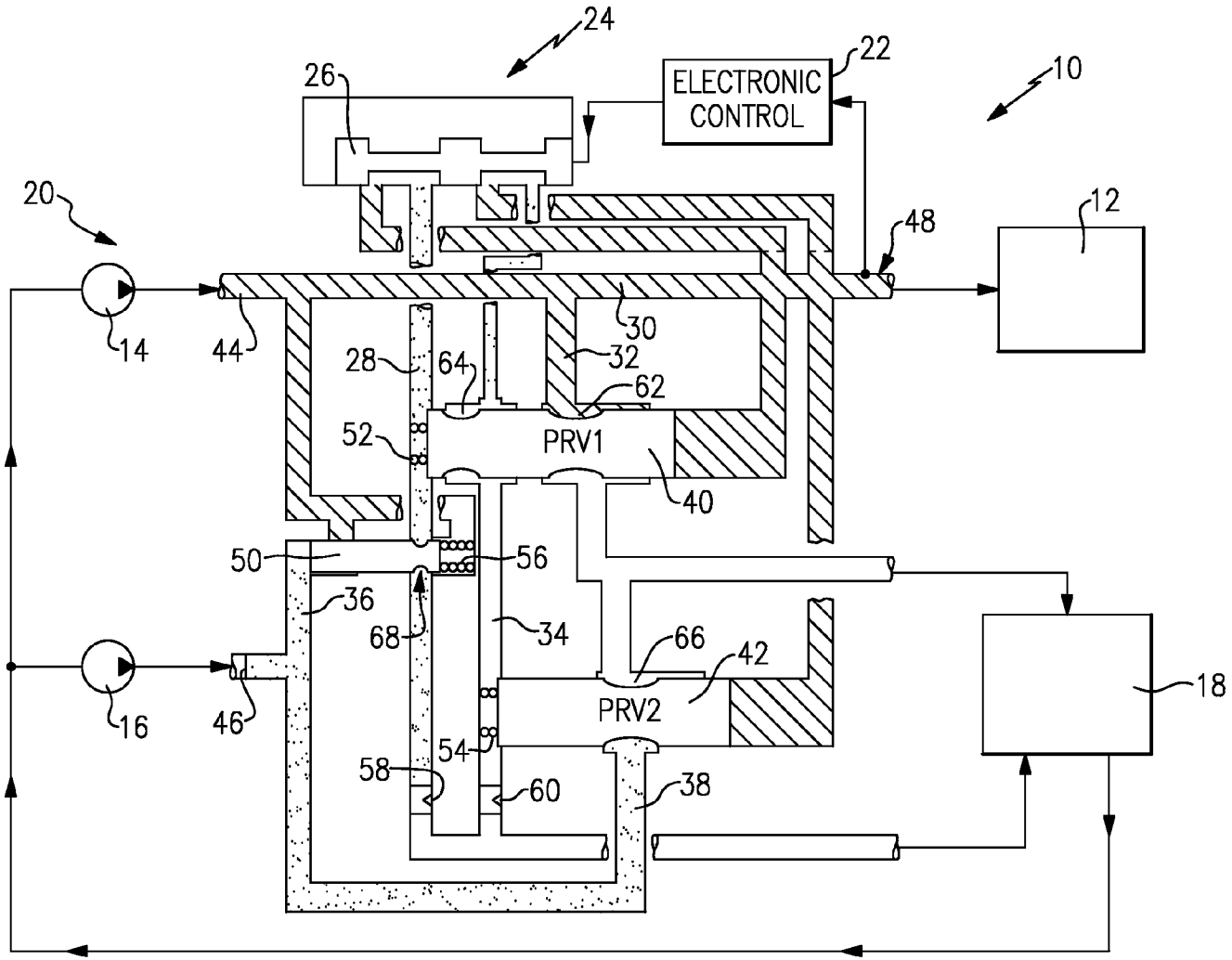
FIG. 1 is a schematic view of an example dual pump regulating control assembly.

Referring to FIG. 1, a hydraulic system is schematically indicated at 10 and includes an actuator 12 that receives fluid flow through a first inlet 44 generated by a primary pump 14 and through a second inlet 46 generated by a secondary pump 16. A regulator control assembly 20 controls fluid flow from each of the primary and secondary pumps 14, 16 such that a desired flow and pressure is maintained at the outlet 48 for varying actuator 12 demands. The primary pump 14 provides sufficient fluid flow for most operational conditions. The secondary pump 16 provides additional fluid flow, whilst maintaining desired pressure, when system demand increases beyond the capability of the primary pump 14. The example regulator control assembly 20 controls the transition from using only the primary pump 14, to using both the primary and secondary pumps 14, 16, to provide a desired fluid flow and pressure through the outlet 48 to the actuator 12. The example actuator 12 can represent a variety of flow consumers, including hydraulic actuation, fuel delivery and lubrication systems.

The example regulator control assembly 20 includes an electronic control 22 that receives information indicative of pressure at the outlet 48. The electronic control 22 generates a control signal that moves an electro-hydraulic servo valve (EHSV) 24 to a position determined to provide the desired pressure. The example EHSV 24 includes a spool valve 26 that proportionally opens fluid flow to control passages that in turn control a pressure reference for a primary control valve 40 and a secondary control valve 42.

As appreciated, the regulator control assembly 20 can be implemented as a separate valve body assembly, and/or may also be included within an existing housing or valve assembly. Moreover, although an EHSV is described, other control valves as are known to set a desired output fluid flow and pressure could also be utilized within the contemplation of this disclosure.

The EHSV 24 controls fluid flow from high pressure outlet feed line 30 to a primary control passage 28 and a secondary control passage 34. The primary control valve 40 and the secondary control valve 42 are spool valves that move within a corresponding chamber, responsive to a pressure differential between a set point control side, exposed to fluid flow and pressure in the corresponding control passage 28, 34, and a relatively high pressure fluid flow, provided through the passage 30, that provides fluid flow to the outlet 48 and the actuator 12.

A pressure differential between fluid pressure in the primary control passage 28 and the passage 30 combined with a biasing force provided by a primary biasing member 52 moves the primary regulating valve 40 into a balanced position to control pressure flow through the outlet 48. The primary control passage 28 further includes a back pressure orifice 58 that provides for a desired rise in pressure relative to a pressure of the supply 18, as commanded by the electronic controller. Fluid flow and pressure exiting through the outlet 48 are controlled by bypass flow modulation with the primary regulating valve 40. Increasing bypass flow, decreases flow and pressure to the outlet 48. Decreasing bypass flow increases flow and pressure to the outlet 48.

The example primary regulating valve 40 includes a primary bypass control window 62 that opens fluid flow and pressure to a primary bypass passage 32 that sends excess fluid flow to the supply 18. The bypass window 62 is opened in proportion to the amount of desired fluid flow at the outlet 48. Regulation of the fluid flow at the outlet 48 occurs by movement of the primary regulating valve 40 responsive to changes in demand.

In instances where the actuator 12 requires additional fluid flow and pressure, the primary regulating valve 40 will automatically move to balanced position providing the required flow. This balancing occurs in response to an increased fluid flow by the actuator 12 and the corresponding drop in pressure on the high side of the primary regulating valve 40. The drop in pressure at 30 results in a reduction in flow through the EHSV 24 spool valve 26, control passage 28 and backpressure orifice 48. A corresponding drop in pressure in control passage 28 ensues, serving as a secondary stabilizing effect on control action.

The drop in pressure on the high side creates an unbalanced condition. Accordingly, the primary regulating valve 40 is pushed toward the high pressure side, toward the right as shown in FIG. 1. Movement toward the high pressure side results in a further closing of the bypass window 62. That, in turn, causes a rise in pressure on the high pressure side, within the passage 30 to the outlet 48, until a balanced position is obtained. Once balanced, the delta pressure across the EHSV spool valve 26 window, from passage 30 to passage 28, is recovered, restoring flow and pressure in passage 28 to their steady-state values.

Similarly, a rise in pressure on the high side within the passage 30 will push the primary regulating valve 40 back toward the control passage 28 side to unblock the bypass window 62 to increase bypass flow and reduce fluid pressure within the passage 30 until the desired pressure is obtained. This balancing of pressures is provided to accommodate changes in demand at the actuator 12 to maintain the desired pressure setting.

In most operational conditions only a portion of pump capacity is required. It is only at extremes of operational capacities that pump flow capacity is fully utilized. However, the positive displacement pump will still generate flow as a function of speed, unrelated to demand. Much of this flow is simply bypassed to the supply 18 during normal operating conditions. Accordingly, the example system 10 uses the secondary pump 16 to accommodate the extreme operating requirements while using the primary pump 14 for most normal operating conditions. When not required, the secondary pump 16 can be operated at a low inlet to outlet pressure differential, minimizing efficiency losses due to internal leakage and greatly reducing heat production intrinsic to pressurizing a large amount of unneeded bypass flow. Thus, the thermal management capacity required to dissipate the extra heat bypass flow introduces to the pump supply system is greatly decreased.

The example regulator control assembly 20 controls the transition between the primary pump 14 and the secondary pump 16. As discussed above, the EHSV 24 sets the desired fluid flow and pressure output to the actuator 12 and increases in demand are accommodated by movement of the primary regulator valve 40. When demand exceeds the capacity of the primary pump 14, the additional fluid flow required to meet demand is generated by the secondary pump 16 and added to that of the primary pump 14.

FIG. 1 illustrates a condition where the primary pump 14 is providing fluid flow to the outlet 48. The primary regulating valve 40 is controlling this fluid flow and pressure by bypassing surplus fluid flow through the bypass window 62 to the pump supply 18. A mixing valve 50 is disposed in a first position that blocks fluid flow from the secondary passage 36 into the primary passage 30 and the outlet 48. A secondary regulating valve 42 is in a full bypass position where all fluid flow from the secondary pump 16 flows through the secondary bypass widow 66 to the pump supply 18.

A secondary control passage 34 that provides control pressure to the secondary control valve 42 is closed to fluid pressure from the EHSV 24 by the primary control valve 40. The example secondary control passage 34 includes the backpressure orifice 60 to increase pressure over that provided in the pump supply 18. A secondary biasing member 54 is also provided in the secondary control passage 34 to bias the secondary regulating valve 42 against high pressure. When the secondary control passage 34 is closed, as shown in FIG. 1, the pressure at the back side of the secondary control valve is very low and essentially the same pressure as that of the pump supply 18. Accordingly, high pressure flow acting on the secondary control valve 42 maintains the control valve 42 in a position that bypasses essentially all flow through to the pump supply 18. In this condition, the primary regulating valve 40 controls fluid flow and pressure to the outlet 48.

Figure 2:
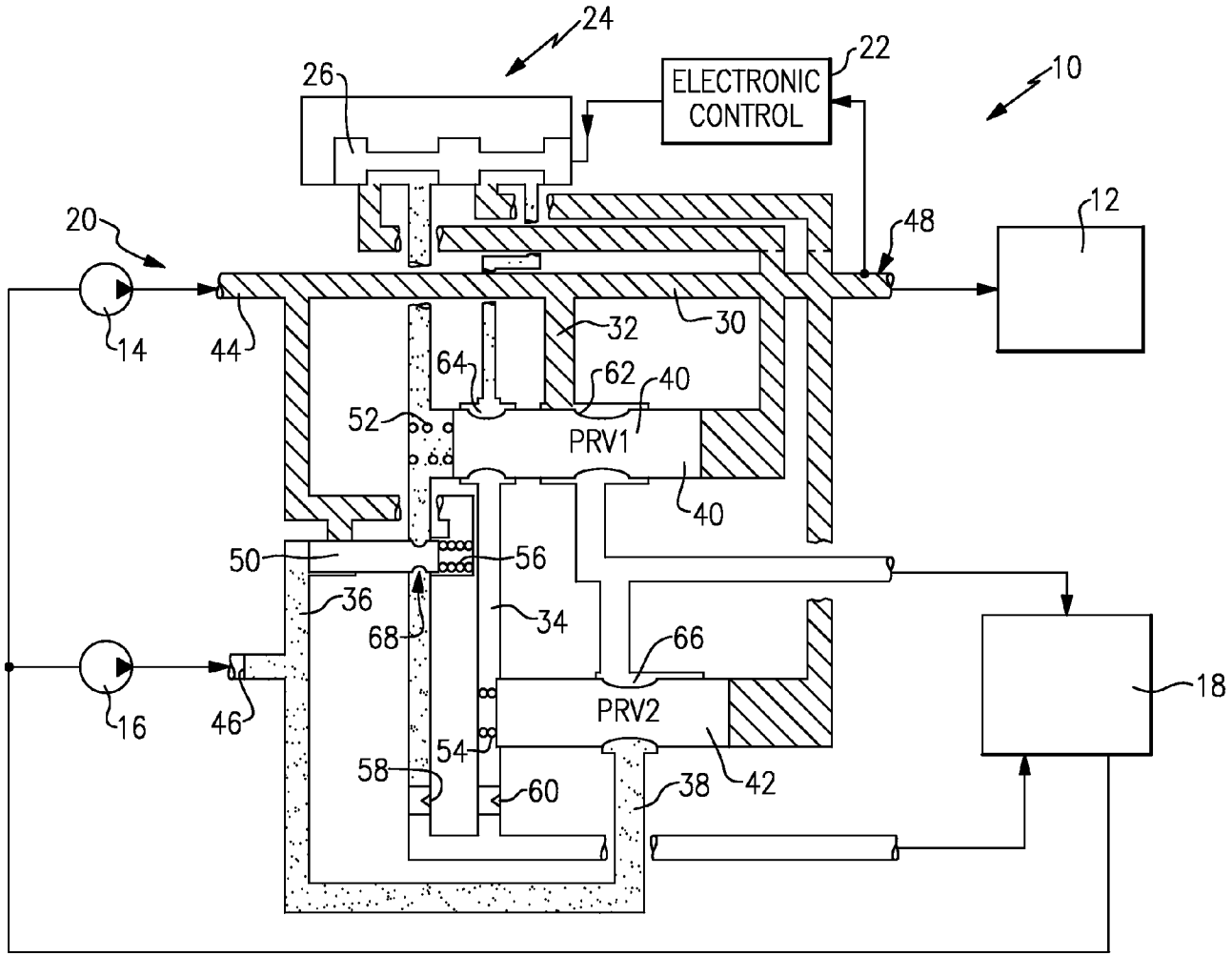
FIG. 2 is a schematic view of the example dual pump regulating control assembly in an initial transition position.

Referring to FIG. 2, in response to increased fluid flow and pressure demands, the primary control valve 40 closes the bypass flow window 62, until all bypass flow through the primary bypass window 62 is blocked as shown here. As the primary bypass window 62 is blocked, a transition initiation window 64 is unblocked and allows high pressure fluid into the secondary control passage 34. High pressure fluid in the secondary control passage 34, combined with biasing member 54 force and decreasing primary flow passage 30 pressure results in an unbalanced force across the secondary control valve 42. The secondary control valve 42 moves to a position that blocks fluid flow through the secondary bypass passage 38 such that the secondary control valve 42 begins regulating fluid flow and pressure.

It is not desirable to have both the primary and secondary control valves 40, 42 regulating fluid flow and pressure. Therefore, as fluid flow and pressure is required from the secondary pump 16, the secondary control valve 42 begins regulating and the primary control valve 40 is latched in a position completely blocking any flow through the primary bypass passage 32. The mixing valve 50 both opens fluid flow and pressure from the secondary pump 16 to the passage 30 and outlet 48, and latches the primary control valve 40 in position.

Figure 3:
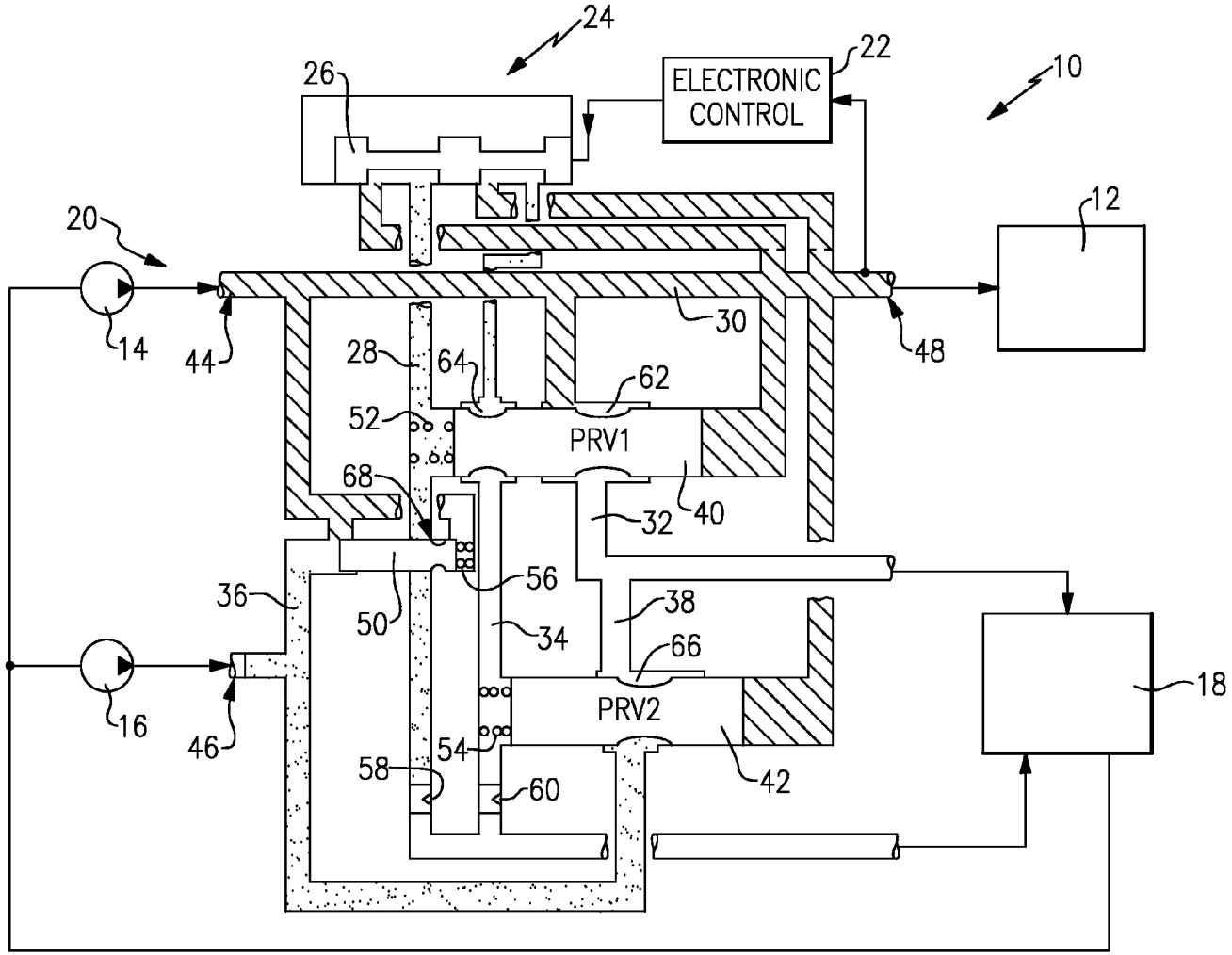
FIG. 3 is a schematic view of the example dual pump regulating control assembly in a transition position.

Referring to FIG. 3, opening of the secondary control passage 34 to fluid flow and pressure causes a movement of the secondary control valve 42 to begin restricting some portion of fluid flow through the secondary bypass passage 38. The reduction of bypass flow area causes a rise in pressure within the passage 36. The mixing valve 50 is in communication with the passage 36 and biased toward a position closing the passage 36 by a biasing member 56. The increase in pressure in the passage 36 caused by the secondary control valve 42 causes the mixing valve to open the passage 36 to the passage 30. At the same time, a mixing valve window 68 that controls flow through the primary control passage 28 begins to close.

Closing of the mixing valve window 68 results in the pressure in the primary control passage 28 increasing to a level substantially equal to that of the pressure within the passage 30. The equal pressures one each side of the primary control valve 40 provide for the biasing member 52 to maintain the primary control valve 40 in the latched position, with flow path from primary bypass passage 32 to pump supply 18 completely blocked. Accordingly, the primary control valve 40 is functionally fixed, and the secondary control valve 42 provides the desired regulation of fluid flow and pressure by bypassing some portion of fluid flow through the secondary bypass passage 38.

Figure 4:
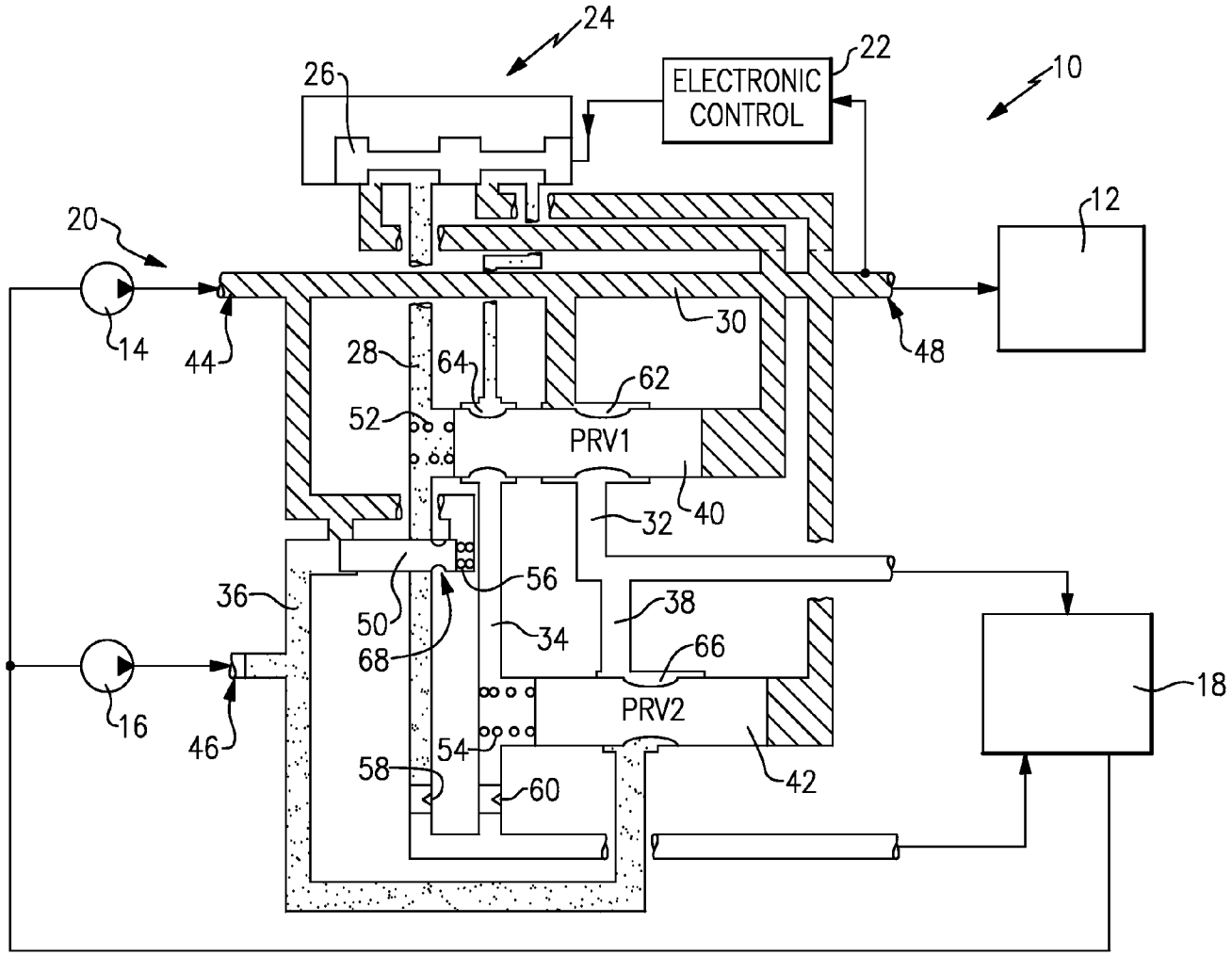
FIG. 4 is a schematic view of the example dual pump regulating control assembly with a secondary pump providing fluid flow.

Referring to FIG. 4, the example regulator control assembly 20 is shown in a condition with the primary control valve 40 latched in a position, blocking all fluid flow through the primary bypass passage 32. The secondary regulating valve 42 is controlling bypass flow through the secondary bypass passage 38. In this operational state, the secondary control valve 42 is the sole pressure regulator and modulator of bypass flow. The mixing valve 50 is in the open position, porting fluid flow from the passage 36 into the passage 30 to the outlet 48. Fluid flow from the secondary pump 16 therefore combines with fluid flow from the primary pump 14 to provide the desired fluid flow and pressure at the outlet 48.

As appreciated, although only one secondary pump is described, additional secondary pumps could be included for potentially increased thermal benefit. Such a system would employ additional primary regulating valves 40, mixing valves 50 and control passages 28 for each additional pump.

The regulator control assembly 20 remains in the state illustrated in FIG. 4, until demand at the actuator 12 falls. As the demand falls, a corresponding increase in pressure at 30 results in a force imbalance on spool valve 42. The valve translates, in the direction to compress the biasing member 54 and open the secondary bypass window 66, allowing additional bypass flow through the secondary bypass passage 38. Pressure in the passage 36 begins to drop. Eventually, the secondary bypass passage 38 is sufficiently open such that all secondary pump 16 flow is bypassed at a lower pressure than the minimum required to keep the mixing valve 50 open. The mixing valve 50 closes the passage 36 from communication with the passage 30. As the mixing valve 50 closes, the primary control passage 28 begins to reopen and results in a corresponding drop in pressure. This results in the primary control valve 40 moving back to a pressure regulating position, modulating primary bypass flow.

Figure 5:
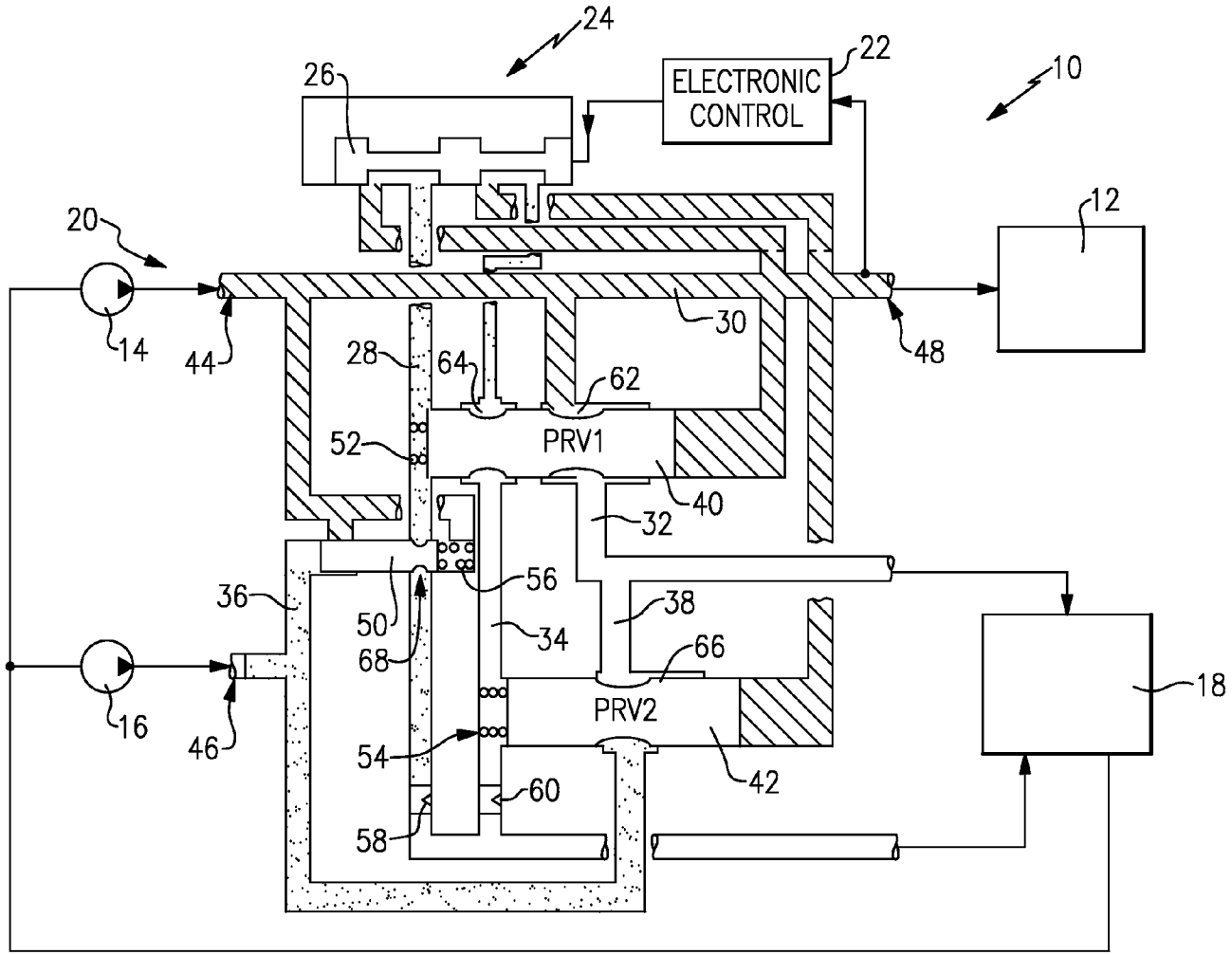
FIG. 5 is a schematic view of the example dual pump regulating control reverting transitioned away from use of fluid flow from the secondary pump.

Referring to FIG. 5, the reduction in pressure in the primary control passage 28 has allowed the primary control valve 40 to move to a position that closes the transition initiation window 64, completely cutting off flow through passage 34. With no flow through passage 34 and, subsequently, back-pressure orifice 60, pressure in passage 34 effectively equalizes with pressure of pump supply 18. This minimum pressure on the control setpoint side of secondary control valve 42 results in translation of valve 42 back to a position providing full bypass flow through the secondary bypass passage 38 to the pump supply 18. In tandem, the drop in pressure in the passage 36 causes the mixing valve 50 to move back to a position closing off flow from passage 36 to passage 30. Simultaneously, mixing valve window 68 opens a flow path from primary control passage 28, through back pressure orifice 58 to pump supply 18. The primary control valve 40 returns to regulating output fluid flow and pressure to the actuator 12.

Accordingly, the example regulating control valve provides smooth transition between primary and secondary pumps without a lag in response time such that the efficiencies of using a dual positive displacement pumps can be utilized.

Although an example embodiment has been disclosed, a worker of ordinary skill in this art would recognize that certain modifications would come within the scope of this disclosure. For that reason, the following claims should be studied to determine the scope and content of this invention.

What is claimed is:

1. A dual pump hydraulic flow system comprising:

a primary pump providing fluid flow through a primary passage;

a secondary pump providing fluid flow through a secondary passage;

a regulator control assembly governing flow from the primary and secondary passages to an outlet, the regulator control assembly including a primary regulating valve controlling fluid flow through the primary passage, a secondary regulating valve controlling fluid flow through the secondary passage, and a mixing valve controlling fluid flow from the secondary passage into the primary passage responsive to a desired fluid flow demand at the outlet; and an electronically-controlled servo valve setting a desired fluid pressure through the primary regulating valve and the secondary regulating valve to the outlet.

2. The pump hydraulic flow system as recited in claim 1, wherein the electronically-controlled servo valve controls fluid flow from the primary passage to a primary and secondary control passage.

3. The dual pump hydraulic flow system as recited in claim 1, wherein each of the primary regulating valve and the secondary regulating valve comprise spool valves movable within a cavity responsive to a fluid pressure applied at each end.

4. A dual pump hydraulic flow system comprising:

a primary pump providing fluid flow through a primary passage;

a secondary pump providing fluid flow through a secondary passage; and a regulator control assembly governing flow from the primary and secondary passages to an outlet, the regulator control assembly including a primary regulating valve controlling fluid flow through the primary passage, a secondary regulating valve controlling fluid flow through the secondary passage, and a mixing valve controlling fluid flow from the secondary passage into the primary passage responsive to a desired fluid flow demand at the outlet, wherein the primary regulating valve includes a primary bypass window that controls fluid flow from the primary passage to a pump supply and a transition initiation window that controls fluid flow to a secondary control passage.

5. The dual pump hydraulic flow system as recited in claim 4, wherein the primary regulating valve increases fluid flow through the secondary control passage responsive to decreasing fluid flow to the pump supply.

6. The dual pump hydraulic flow system as recited in claim 5, wherein the secondary regulating valve includes a secondary bypass window that controls fluid flow from the secondary passage to the pump supply.

7. The dual pump hydraulic flow system as recited in claim 6 wherein the primary valve is in communication with a primary control passage and the mixing valve closes the primary control passage for latching the primary regulating valve in a fixed position such that the secondary regulating valve governs fluid flow through the primary passage and the secondary passage to the outlet.

8. The dual pump hydraulic flow system as recited in claim 7, including a primary biasing member biasing the primary regulating valve toward a position blocking bypass fluid flow and a secondary biasing member biasing the secondary regulating valve toward a position blocking bypass fluid flow.

9. The dual pump hydraulic flow system as recited in claim 7, including a backpressure orifice disposed in each of the primary and secondary control passages, wherein each of the primary and secondary control passages are in communication with the pump supply.

10. A regulator control assembly for controlling flow from two sources, the regulator control assembly comprising:

a control valve defining a desired fluid pressure through an outlet;

a primary regulating valve controlling fluid flow and pressure through a primary passage to the outlet from a primary fluid flow source;

a secondary regulating valve controlling fluid flow and pressure through a secondary passage to the outlet from a secondary fluid flow source;

a mixing valve latching the primary regulating valve in a desired position responsive to a desired fluid flow through the primary and secondary passages to the outlet; and a primary control passage and a secondary control passage, the mixing valve controlling flow through the primary control passage and the primary regulating valve controlling flow through the secondary control passage, wherein the primary regulating valve comprises a spool including a bypass window that controls flow from the primary passage to a pump supply and a transition initiation window that controls fluid flow through the secondary control passage.

11. A regulator control assembly for controlling flow from two sources, the regulator control assembly comprising:

a control valve defining a desired fluid pressure through an outlet;

a primary regulating valve controlling fluid flow and pressure through a primary passage to the outlet from a primary fluid slow source;

a secondary regulating valve controlling fluid flow and pressure through a secondary passage to the outlet from a secondary fluid flow source; and a mixing valve latching the primary regulating valve in a desired position responsive to a desired fluid flow through the primary and secondary passages to the outlet, wherein the mixing valve is movable between a first position that allows fluid flow from the primary control passage to a pump supply and a second position that blocks fluid flow through the primary control passage and allows fluid flow from the secondary passage to the primary passage.

12. The regulator control assembly as recited in claim 11, wherein the primary regulating valve is latched in a position blocking fluid flow from the primary fluid flow passage to the pump supply and the secondary regulating valve controls fluid flow from the secondary passage to the pump supply to control fluid flow through the outlet when the mixing valve is in the second position.

13. The regulator control assembly as recited in claim 12, including backpressure orifices in each of the primary and secondary control passages.

* * * * *